US005088012A

United States Patent [19]

Burgess

[11] Patent Number: 5,088,012

[45] Date of Patent: Feb. 11, 1992

[54] HIGH INTENSITY PLANAR LIGHT SOURCE

[76] Inventor: Kenneth G. Burgess, 92 Knollwood Dr., Old Saybrook, Conn. 06475

[21] Appl. No.: 616,361

[22] Filed: Nov. 21, 1990

[51] Int. Cl.[5] ..... G09F 13/04

[52] U.S. Cl. ..... 362/97; 362/252; 362/294

[58] Field of Search ..... 362/97, 33, 31, 227, 362/240, 252, 294, 373; 40/361

[56] References Cited

U.S. PATENT DOCUMENTS

| | | | |
|---|---|---|---|
| 3,356,839 | 12/1967 | Mehess et al. | 362/97 |
| 3,808,416 | 4/1974 | Pottratz | 362/97 |
| 4,184,194 | 1/1980 | Shofu | 362/97 |
| 4,267,489 | 5/1981 | Mozohashi | 40/361 |
| 4,791,540 | 12/1988 | Dreyer, Jr. et al. | 362/97 |
| 4,943,689 | 7/1990 | Siefer et al. | 362/97 |

*Primary Examiner*—Ira S. Lazarus
*Assistant Examiner*—Richard R. Cole
*Attorney, Agent, or Firm*—McCormick, Paulding & Huber

[57] ABSTRACT

A high intensity planar light source utilizes an array of halogen lamps to produce high intensity, flat field and stable color temperature illumination. The halogen lamps are arrayed in a rectangular area with a nonlinear distribution which locates a higher density of lamps in the corners of the array than elsewhere in the peripheral regions of the area. The array of lamps is energized by a DC power supply and series circuitry is employed to make the failure of one lamp easily detected.

20 Claims, 5 Drawing Sheets

HIGH INTENSITY PLANAR LIGHT SOURCE

BACKGROUND OF THE INVENTION

The present invention relates to a high intensity, planar light source, providing flat field and uniform color temperature illumination. The source is useful for illuminating films, transparencies and like objects where high resolution is required for digital and analog imaging. The requirement arises in fields such as aerial reconnaissance, lithography, color and black and white film interpretation and enhancement. Generally any circumstance which demands bright, even illumination over a large viewing area for scanning, computer absorption or real time viewing is a candidate for the source.

Illumination devices conceal the complex and subjective technology of light, a commodity which when improperly applied can bring the most sophisticated, well understood imaging system directly to its knees. System specifications for illumination may be vague or left to the final user. Expensive digital devices are long paid for when illumination deficiencies become apparent and it is then that critical light parameters such as luminous intensity, spectral irradiance, illumination flatness, and spectral output become an unwelcome part of our vocabulary. Such parameters among others, define the limits of light source output and predict the performance of sensors and imaging equipment. Direct symptoms of an unfit light source are not limited to elongated exposure times (reduced throughput), but can also include inaccurate image characteristics, poor color rendering and, in general, otherwise unresolvable image characteristics.

Light and light measurement are among the least understood of technologies. Discussion and communication of desired operating parameters are complicated by a plethora of names for seemingly similar units of measurement. Additionally, measurements relate to "perfect surfaces" or "point sources" which are themselves located inside "perfect reflectors" or above "perfect planes". Measurements of color, for example, often appear and sometimes are subjective in nature and seemingly an art form rather than part of any science. Only those definitions which are measurable on actual functioning devices are discussed below.

Digital and Analog Sensors

The actual sensing element in a digital or analog vision system (the CCD, CID, or tube) whether used for B & W or eventually filtered for specific "colors" such as in an RGB camera, will see in "color". There are specific bandwidths or wavelengths of light which maximize the response of the sensor and provide it with an optimum operating environment. Matching the sensor to the wavelengths of light it wishes to sense is the first critical rule of effective digitizing practice and will affect the performance of the unit.

Sensor Spectral Responsivity

In order to understand the generalization of light it is first necessary to understand spectral responsivity. The complete electromagnetic frequency spectrum spans the full distance from cosmic rays down to electric power frequencies. The human eye is sensitive to only a small portion of this spectrum which is divided into three basic additive components, namely visible red, green and blue.

The eye's response is not the same to all specific colors but varies as the frequency of the light (and corresponding wavelength). It is known that camera sensors also have the characteristic known as spectral responsivity which can be represented by a responsivity curve. Responsivity curves for sensors vary in shape and in latitude, that is the accepted wavelengths, over a wide range depending upon the type of sensor, such as tube types, or solid state sensors, such as CCDs (Charge Coupled Detectors) and CIDs (Charge Induced Detectors).

A responsivity curve which defines a relatively flat response suggests that the camera will see a wider latitude of light frequencies than will the human eye. Even with a flat response, graphical analysis will reveal that altering the sensed (or illumination) wavelength from 400 to 650 nanometers will provide an increase of 50% in the spectral responsivity of the camera. This will result in increased camera response for a given light intensity (or less intensity at the new wavelength is required to achieve the same result). This suggests that if the scan time is photon dependent (scan speed is controlled by the rate at which a minimum number of photons affect the charge display wells), shifting the illuminant from 400 nm to 650 nm could reduce the scan time and thereby increase scanning throughput by 50%.

Sensor specifications often relate to a specific illumination color such as 3200K. This notation is the illumination color temperature. A definition of illumination color is given below. What is important to note here is that the illumination color specified is logically that which provides optimum performance. When filters are used in front of the sensor, the sensor responsivity curve is unaltered; however, the sensor will now see only a portion of the original illumination wavelengths.

Illumination Color

With sensor response defined, the next consideration surrounds the illumination source. In the photon sensitive camera a minimum number of photons must pass through the film and trigger each display well to assure specified performance. The more general condition of solid state and tube type sensors is not backed by "rate of scan" software. In such cases the sensor must see all of the gray shades or colors represented above the highest level of noise in the camera and imaging system itself. If there is not enough illumination available at the side of the film facing the camera, then significant losses in contrastual and spatial resolution can occur. This exercise becomes film dependent, intensity dependent, and illumination wavelength dependent. The "color" of the illumination used therefore determines the efficiency and effectiveness of the entire digital processing system regardless of whether the film is black and white or color.

The maximum density of the proposed film, the wavelength of the illumination source and the stated sensitivity of the camera sensor compensated for the lens must be taken in account. The scanning of a color film where the film itself acts as an infinitely variable filter causes the camera to modulate along the responsivity curve. Each time the various hues of blue, green, and red are individually scanned, the sensor follows its responsivity to a different efficiency index and absorbs the varying intensities of light. The component values of the light source become critical. For example, if the light source has a limited or low "blue component" the result would be exceptionally slow or underexposed by the camera due to the "blue" cycle. In the case of scanning red, the use of a highly blue slanted source with little or no red output causes the sensor to have reduced input and subjects the sensor to the danger of "seeing" heat leakage (generated deep in the source components) through the illumination port.

Measuring and Matching Illumination Color

To understand more fully the response characteristic problem in color systems it is necessary to first understand the relationships between spectral irradiance, and our previously mentioned characteristic, color temperature. There are no less than four methods of measuring the color (colorimetry) of an illumination source. They include color matching wherein a human observer actually matches physical samples, color temperature wherein actual chromaticity components are measured to provide graphical interpretation, tristimulus colorimetry where filters are used to match the tristimulus spectral response functions and finally spectroradiometric measurement over the entire light spectrum.

Because color is a psychophysical phenomenon, numerous physical observer-based experiments have been conducted over the years with the intent of achieving reproducibility in readings and reducing human subjectivity. In the 1920's a series of observer based experiments were conducted culminating in 1931 when an actual chromaticity diagram was mapped. The diagram was developed to allow a basis for color matching through the combinations of the three primary color components graphically termed x, y, and z. The 1931 Chromaticity Chart or CIE diagram (in use today) was the first time that a series of numerical coordinates could be provided to designate a specific color.

Illumination sources for most imaging systems are of course not one specific color but a bandwidth of wavelengths, a graduation of colors, each with a differing amplitude. This leads us to the concept of "color temperature", a unique application of the chromaticity diagram and a convenient method of describing the color of many common light sources.

The notion of color temperature is based upon incandescence of a perfect "black body radiator" which is heated through a temperature range (measured in degrees Kelvin) to provide reference colors. As the temperature of the block body increases, it will eventually incandesce or emit a color. A rod of steel appears as a dull red when sufficiently heated. The same is true of a tungsten light filament when sufficient current is passed. Both items have reached a point of incandescence. A special class of incandescent "black bodied" objects are assumed to have radiant efficiency of 100%, against which real world materials are measured. Tungsten, for example, has an efficiency of 40% and simulates a "black body" in color but not in its output strength for a given temperature. Each "blackbody" curve defines the spectral irradiance for a given temperature producing a family of curves (shown in FIG. 1) which identify the color sensations. The family line drawn through the maximum values is called the Plankian Locus. Note that each temperature curve has a spectrum over which it has radiation, so color temperature does not express one specific color but a bandwidth of color located about its color temperature locus.

The specification of color temperature defines completely the color distribution of a source close to the Plankian locus and can be determined by using ratios of blue and red (measured spectrometrically). The result is referenced to a calibration curve, or a direct reading color meter can be used. Such meters employ special filters with light absorbing characteristics and photocell response which duplicates the CIE diagram. Several of these designs also have microprocessors on board to calculate the color temperature directly. Illumination devices such as arc or fluorescent lamps provide "apparent" color temperatures and must be indicated as such. Such illumination devices may be lacking in certain components of the appropriate black body spectrum or may have components which are amplified. In the case of these illumination sources a three color ratio must be accomplished or one must use a three color meter equipped with "flicker" correction where applicable.

Illumination Curve Continuity

Effectively then, for black and white imagery the color temperature of the source should at least theoretically match the condition required by the spectral efficiency (or responsivity) of the camera sensor. In halide based black and white imagery, the light intensity at the sensor will change as the interscene dynamics are scanned by the camera; however, the color temperature will not. The blackened areas will merely function as an increasing or decreasing neutral density filter dependent on the darkness or lightness of the film at any given point.

In the case of color imaging the effective color and therefore the "at point measurable color temperature" will constantly be in motion at least from the camera perspective. The efficiency of the color swing and the faithfulness with which it is recorded will depend now on the faithfulness and spectral emissivity of the source itself. This faithfulness will in no small part be a function of the continuity of the spectral curve of the light source, a new variable ascertainable only by complete spectral distribution analysis (Spectroradiometric analysis).

Many image processing systems have the ability to adjust for shifts in color, (i.e. the film was exposed at 3200k but is now illuminated at 3000k). Such processing assumes the continuity and conformity of the illumination curve; however, spikes in the illumination source curve suggest that the operator may have little knowledge of the true emphasis that certain sources can place on data at unique points in the illumination spectra. Since analysis systems are being used more and more in sophisticated discrimination problems, the spectra of the illumination curve can obviously produce results which may not be represented by real data. Enhancement of generated data only enhances the problem.

Source Aging Stability

Once the proper color temperature of a source is chosen, the stability and reliability of the source must be considered. Terms such as day-light white, true white, tungsten white, and daylight fluorescent, all refer to specific if not exclusive operating conditions under which a light source may theoretically operate, but provide no information as to consistency, spectral aberrations or stability.

Imaging errors can occur when the source changes general characteristics or stability over its lifetime. An image processed today should yield the same results in hour or a week from now. Repeatability (especially long term) is sometimes beyond the capability of but a few illumination sources.

Voltage Regulation and Stability

While aging stability speaks of long term variances, short term voltage equilibrium is just as critical to the success of the operating illumination and imaging system. Voltage regulation or duty cycle fluctuations inherent in the power supply can completely alter the operation of an illumination system. All illumination systems operated on 60 hz AC will provide dramatic short term variation in output. If the frequency is high enough, (several Khz) the illumination response is not quick enough to follow the rapidly generated curve and the effect is minimized. Where possible, as in the case of planar illumination, all power should be low ripple direct current (DC). The r.m.s. ripple (the flatness of the DC waveform) should be very low (the order of 1% or less). Even a 1.5% ripple (considered reasonable for illumination power supplies) can be troublesome. This is because the normal ripple is calculated in reference to the power supply output voltage; however, the luminous (light emissive) output ripple can be higher (around 4 times higher in some cases) at the blue end of the spectrum. The high frequency spectral distribution tail is significantly more sensitive to temperature variation (and therefore instantaneous operating voltages than the red (lower) end.

Primary input voltage fluctuation (in the 120v or 240v, 50/60 cycle line) can and will affect lumen output (perhaps during a scan line) and alter color temperature. The affect of cyclical variation and input peak variation may be additive or subtractive dependent on the portion of the film being processed and whether the shift is upward or downward. Such effects on image quality are therefore unanticipated and difficult to diagnose.

Luminous Intensity

There are actually three separate systems of units used in light measurement, the CGS, the English and the SI (international convention). Many of the terms such as foot-candle and candela are very misleading. For purposes of this application, it is assumed that the film is in direct contact with the illumination port or surface. All radiation is or is nearly perpendicular to the film, and the intensity is measured directly in contact with the port surface. For continuity and common language, the units recommended to measure the light from a source should either be the footlambert or, in metric terms, candelas per meter squared. The footlambert is a measurement of one lumen of flux emanating from one square foot. One lumen illuminating from one square meter is 10.74 lux or one candlepower. There are 10.74 sq. ft. in one square meter so the conversion factor between lux and candlepower is 10.74. Thus, lux or candlepower is a measurement of illumination (illuminance) falling on a surface rather than luminance or brightness emanating from a source. Correspondingly, camera sensors are illuminated (measured in candle power or lux) by the luminant source (measured in footlamberts or candelas per sq. meter). The lumen is a measurement of radiant intensity common to both measurement systems and was subjectively developed from interpreting the illumination a perfect candle would provide through a perfect lambertian diffuser, the opposite side thereby irradiating one footlambert. Notwithstanding, it is a reproducible standard providing credence to this particular measurement unit.

There are many commercial meters on the market today which will measure in both or at least one of these units of measure. Parameters surrounding the choice of illumination will most usually be specified in some form or another in a specification sheet for the camera system (the illuminated sensor). Such a specification would be as follows:

Minimum Illumination: 12.5 lux at F=1.4, 3200k

Determination of Intensity Requirement

The camera, given in the example above, will respond adequately to an illumination level of 12.5 lux with an assumed quality lens operating at an f-stop of 1.4, and an illumination color temperature of 3200k. It is impractical that the camera system will operate with its lens at 1.4 exclusively but rather at several f -stops higher which would increase the illumination requirement by say a factor of eight or sixteen. The specification assumes that the system is looking directly at the light source with no film between it and the camera. It is recommended therefore to start with a densitometer and a "typical film" to determine the attenuation factor of the film, then multiply the factor by the lens-stop corrected minimum lux factor. In real practice the combined correction factors can be in the order of several thousand for certain applications. A typical application calculation is as follows:

Based on the information provided in the above specification, the minimum lux necessary to provide an image on the sensor is 12.5 lux. Given that the lens is to be operated at f 4.0 and not 1.4 the light now entering the camera is $\frac{1}{8}$ of the original intensity (halved with each increase in f-stop). If the highest density measured on a typical film is 3.0 then the transmission will be only 0.1% of the original illumination at that point. Assuming that the camera is used in a straightforward manner (no photon dependent software or image averaging) then the minimum intensity for illumination would be:

12.5 lux divided by $\frac{1}{8}$ divided by 1/1000.

The illumination at the film surface needs to be $12.5 \times 8000$ or 100,000 lux! (assuming that the illumination is at 3200K)

The calculation for this low lux camera is typical. Ranges of 50,000 lux to 150 000 lux are nominal for digital imaging systems. As with most things, it is easy to stop the system down or provide neutral density filters when necessary but impossible to generate additional illumination from a system already operating at maximum.

Illumination Flatness

The above illumination calculation suggests that the minimum illumination required at any point on the film is 100,000 lux. This assumes that the flatness of illumination can provide that illumination intensity as a minimum. "Hot spots" or "shadows" will not only detract from the image quality but may also provide that some areas may be grossly underexposed. Most digital imaging systems digitize the lumination source with no film present and then subtract the image from future film sequences to compensate for illumination variance across the scene of view. This corrects for flatness consistency but will not correct for points which are below the minimum illumination requirement.

It is important to utilize the flatness coefficient specification in determining the minimum available intensity as shown in this example.

To guarantee a 100,000 lux illumination intensity at any point a 110,000 lux illumination is specified with a flatness coefficient of $+/\pm 5\%$ maximum variance.

$110{,}000 \text{ lux} \times 0.95 = 104{,}500 \text{ lux}$

This sensor-received illumination would allow detection of the image at all points without concern regarding minimum signal levels at the sensor.

A number of light sources have been used for digital imaging techniques in the past. Fluorescent gas sources have been utilized in many applications; however, such sources must be synchronized with the scanning of the camera because the sources turn on and off with the AC excitation and the intensity of the image varies accordingly. Synchronization with the camera is a complex procedure and significantly reduces the rate of throughput. Fluorescent sources are also inherently low in intensity and do not have a constant color temperature from one end of the fluorescent tube to the other. Additionally fluorescent sources change color temperature almost immediately upon use and lose brightness within the first 10 hours of use. In summary, gas type tube sources have low brightness levels, lack uniformity in color temperature and intensity, vary intensity over the power operating cycle, and immediately suffer degradation of brightness and color temperature when placed in use.

Halogen lamps, on the other hand, are considerably more desirable. They generate a significantly higher level of brightness for their size and have a stable color temperature over the life of the lamp. The drawbacks of a halogen lamp are the considerable amount of heat which they generate in use in comparison to the fluorescent lamps, and they too vary in brightness over the power duty cycle. Another disadvantage of halogen lamps is that the light is effectively emitted from a point source, namely the filament of the lamp, and hence flatness of the field of illumination, that is, uniformity over a wide surface area, is difficult to achieve. One elaborate technique in the prior art for obtaining flat field illumination from halogen lamps employs an integrating sphere in which the lamps are mounted facing into the interior of a large sphere, and a hole or port is cut in the sphere (not facing any lamp) with a radius that is much smaller than the diameter of the sphere (usually 5–10%). The interior of the sphere is surfaced with a lambertian reflective material (diffuses light with a cosine characteristic without transmission loss), and the output illumination is sampled through the hole or port. The obvious disadvantage of such a system is size. For a planar 10 inch×10 inch illumination area (the minimum size for much aerial photography), the sphere approaches three feet in diameter. For larger viewing areas such as 14 inches×17 inches, (the size needed for reading X-rays in medical applications) the sphere may have to be 4 feet×6 feet in diameter. Along with the size problem is the necessity for cooling the entire structure due to the heat generated by the lamps.

Still a further problem that exists with prior sources is the difficulty of detecting the failure of only one lamp which decreases the intensity of the source but often in a little noticed manner because of the limited effect that one of a plurality of lamps will have on the total output of the source.

It is therefore, a general object of the present invention to overcome the difficulties of the prior art illumination sources and to provide a light source having many of the desirable characteristics needed for digital imaging as discussed above.

It is a further object of the present invention to provide a high intensity illumination source which possesses flatness of field, high level illumination and color temperature age and operating stability for use with digital cameras and other devices.

SUMMARY OF THE INVENTION

The present invention resides in a high intensity planar light source which produces flat field illumination of high intensity and has color temperature stability. The light source is particularly useful in high resolution, digital image processing, aerial reconnaissance, lithography, color and black and white film interpretation, photographic enhancement and other processes which require a bright, even illumination over a large viewing area for computer absorption or real time viewing.

The high intensity planar light source includes a frame defining a rectangular illumination surface on which films and other objects to be illuminated are positioned for viewing. The light from the source emanates from an array of lamps, such as halogen lamps, each of which has a light emitting element and all of which are disposed generally equidistant from the rectangular illumination surface defined by the frame. The lamps are arrayed in a rectangular area with the sides of the area being generally parallel to the respective sides of the rectangular illumination surface of the frame. At least some of the lamps are arranged with the light emitting elements distributed along the peripheral region of the rectangular area, and within this region the lamps are distributed with a higher density of the light emitting elements near the corners of the rectangular area than at the major axes of the area.

The density distribution of the lamps is nonlinear and selected to provide the flatness of field or uniform brightness throughout the rectangular illumination surface. In one form of the invention, the lamps are halogen lamps and a heat absorbing shield is positioned between the array and the illumination surface to reduce the amount of heat reaching the object being illuminated. The lamps are preferably excited by a DC power supply with low ripple voltage to provide a steady illumination. The detection of a lamp failure is improved by stringing or interconnecting the lamps in one part of the array in series so that a failure of one lamp results in a noticeable loss of illumination from one part of the source.

DESCRIPTION OF THE DRAWINGS BRIEF

DESCRIPTION OF THE PREFERRED EMBODIMENTS

Figure 2:
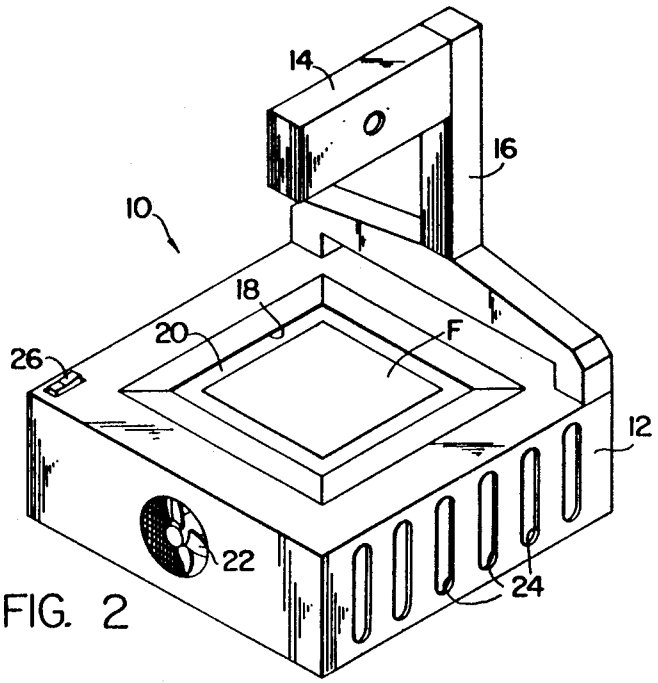
FIG. 2 is a perspective view of a photographic apparatus that employs a high intensity planar light source in accordance with the present invention.
Figure 1:
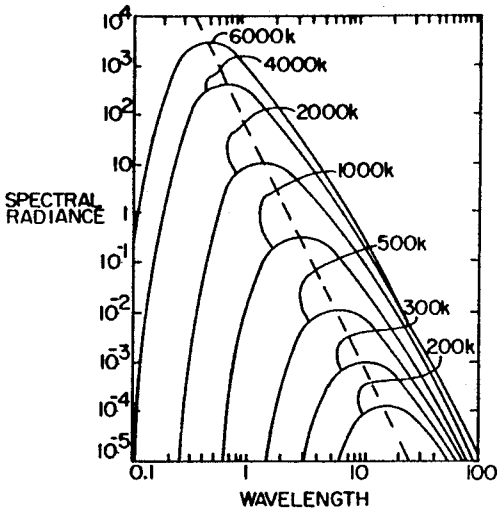
FIG. 1 is a graph showing a family of black body curves which define the spectral irradiance of a body at given temperatures.

FIG. 2 illustrates a photographic apparatus, generally designated 10, which employs a high intensity light source in accordance with the present invention. The apparatus 10 includes a base 12 which forms the structural foundation of the apparatus and a camera 14 which is supported above the base 12 by means of a column 16. The camera 14 is located directly above the geometric center of an opening 18 exposing a rectangular illumination surface 20 at the top side of the base 12. The illumination surface is part of a high intensity planar light source (not otherwise visible and mounted within the base 12).

The camera 14 is a video, photographic, digital or other type of camera or may be another type of viewing instrument for recording or reading the image in a photographic film F, transparency or other object which is placed on the illumination surface 20. The illumination provided from the source at the surface 20 has a high intensity, a flat field or uniform brightness of illumination, and stable color temperature and operating characteristics so that the camera 14 can scan or generate a very accurate, high resolution record of the image in the film F. Such reading or recording may be for purposes of aerial reconnaissance, lithography, color and black and white film interpretation, image enhancement or numerous other digital and analog functions. The important characteristics of the illumination generated by the source is that the illumination at the surface 20 be bright, uniform in time and location throughout the entire area of the surface. Depending upon the type of camera used and the purpose for the apparatus, the peripheral portion of the illumination surface 20 which is not covered by the film F may be masked.

The base 12 of the apparatus 10 contains one or more ventilating fans 22 and a plurality of openings 24 to remove heat generated by the source 12 and keep the components of the source and the film F at acceptable operating temperatures. An ON/OFF switch 26 is provided to turn the light source as well as the ventilating fans 22 on and off.

Figure 3:
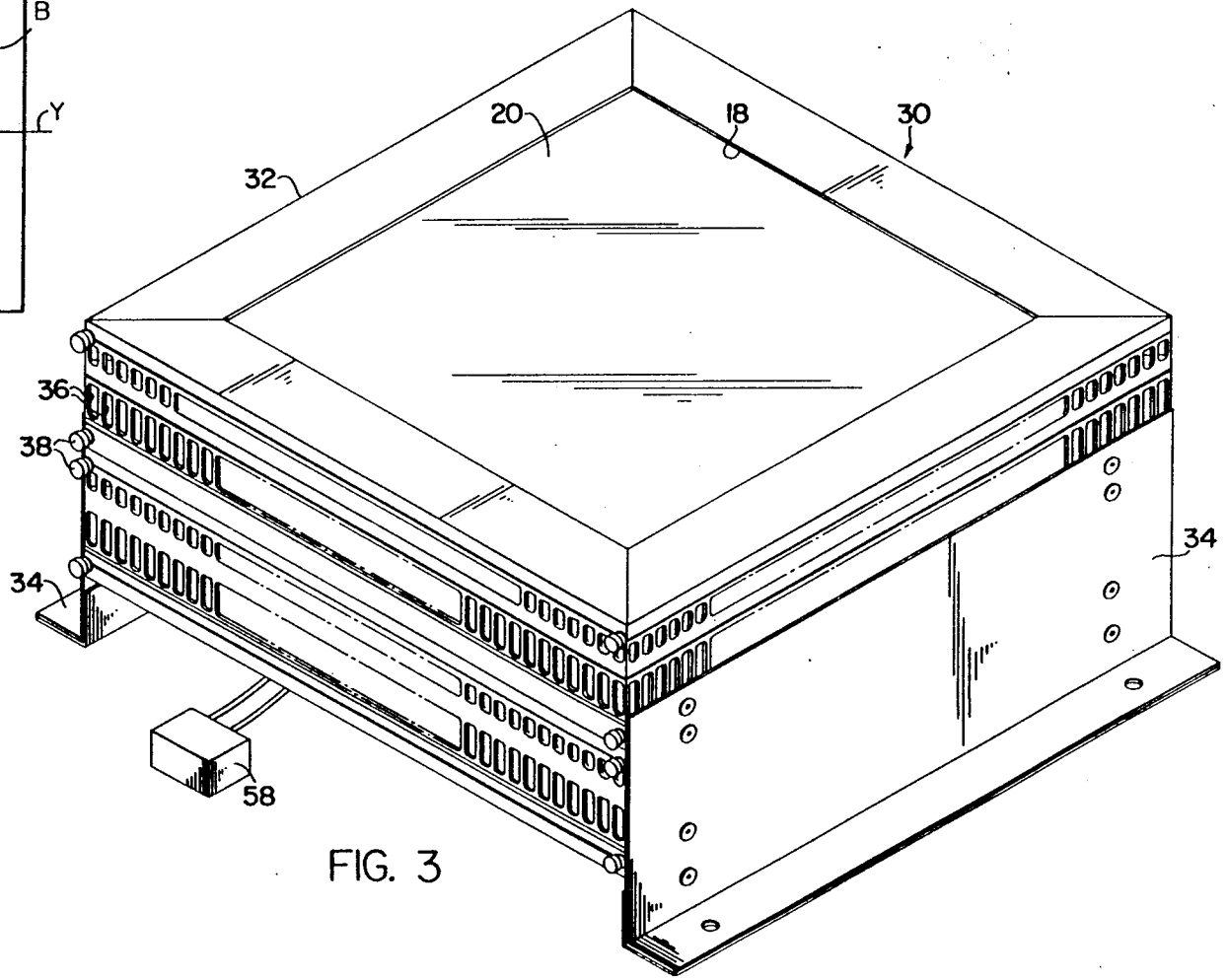
FIG. 3 is a perspective view of the high intensity planar light source in one embodiment of the invention.

FIG. 3 illustrates the high intensity light source, generally designated 30, which is mounted within the base 12 of FIG. 2 with the illumination surface 20 exposed at the opening 18. Of course, the source may be mounted with a vertical, rather than a horizontal orientation, if required by the particular application, such as reading X-rays. The source 30 has a ventilated frame 32 which is mounted by means of brackets 34 within the base 12 for free circulation of air through apertures 36 in the frame. Thus the interior of the source where significant quantities of heat are generated when the illumination source is in operation is cooled by air circulated throughout the structure.

Figure 4:
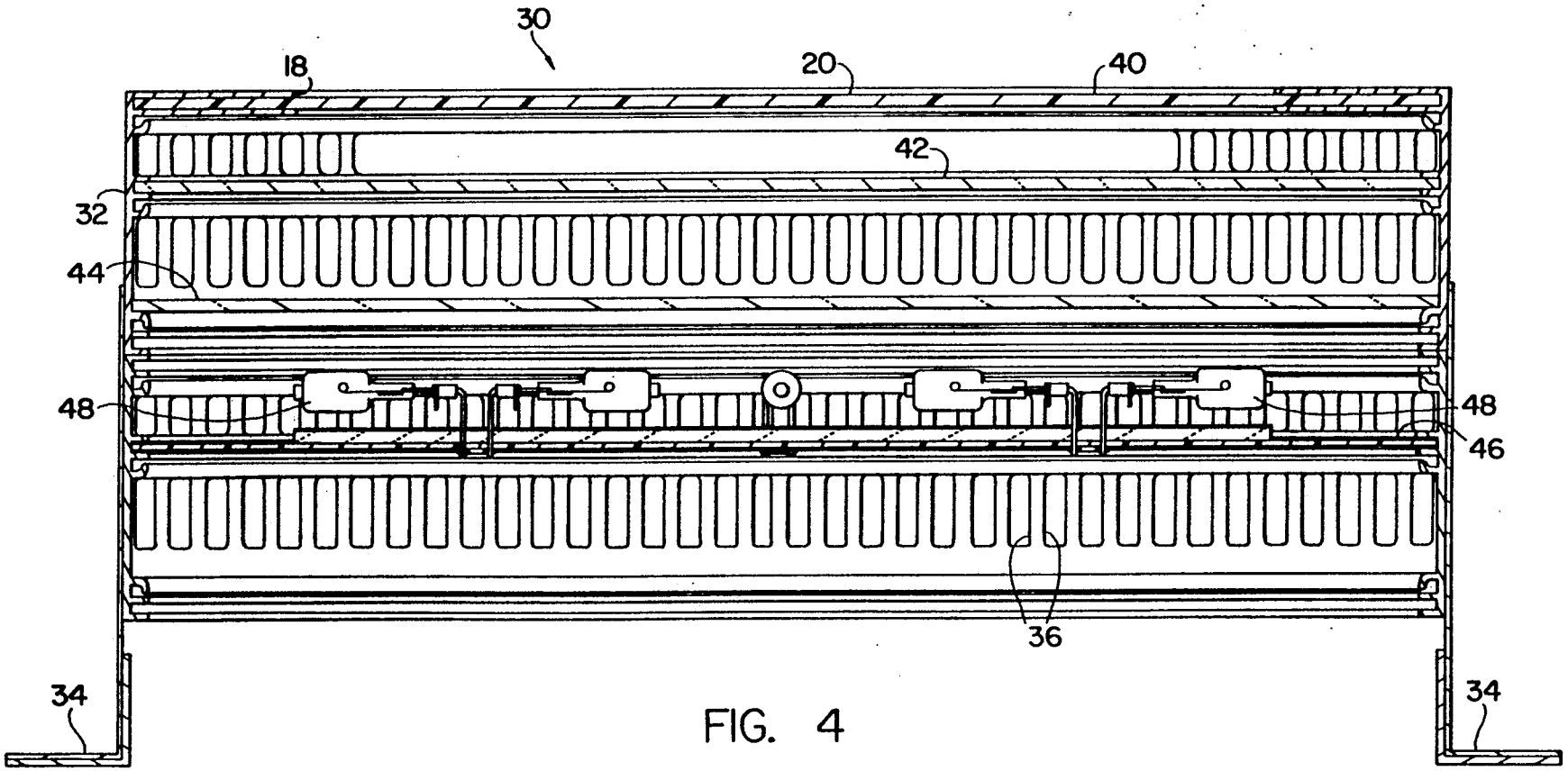
FIG. 4 is a cross sectional view of the high intensity light source in FIG. 3.

As shown in FIGS. 3 and 4, the light source 30 has a generally stratified structure and includes a plate-like diffuser 40, the upper surface of which defines the illumination surface 20, a transparent heat absorbing shield 42 spaced in parallel relationship below the diffuser 40, another diffuser 44 placed below the heat shield 42 and a circuit board 46 on which an array of lamps 48 is mounted with the lamps generally equidistant from the illumination surface 20. The diffusers 40 and 44 as well as the heat shield 42 and the circuit board 46 are all supported in parallel relationship within the frame 32 by means of slots or shelves on the frame members. In a preferred embodiment of the invention, the frame members at each side of the frame 32 are formed from aluminum extrusions in which the shelves and slots are integrally formed. The ventilation slots 36 are stamped from the extrusions. The various frame members are then assembled in the rectangular frame shown more clearly in FIG. 3 by means of thumb screws 38. By removing the thumb screws at one side of the frame 32, the various diffusers, heat shield and circuit board can be slid in and out of the frame as needed.

In one embodiment, the diffuser 40 which defines the rectangular illumination surface 20 at the top of the light source is a sheet of white acrylic plastic with a P95 finish. The diffuser is desirable at this surface so that film and other objects may be viewed by the camera 14 at angles departing slightly from the perpendicular.

On the other hand, the diffuser 44 mounted immediately above the array of lamps 48 is a ground glass plate lapped with a 30 microgrit. Obviously, both of the diffusers are utilized to spread the light generated by the lamps 48, which are effectively point sources, so that by the time the light reaches the surface the light from the point source is distributed over the entire rectangular area of the illumination surface 20.

The transparent heat shield 42 in one embodiment is made of a heat absorbing glass plate made by Schott Glaswerke of Mainz, West Germany, style KG3. Such a glass is particularly desirable when the lamps 48 are halogen lamps since the glass shifts the color temperature of the lamps upward from 3050k to 3200k which is an ideal color temperature for digital cameras. The heat shield, of course, protects the film and plastic diffuser 40 from the intense heat that is generated by the lamps 48 mounted at a lower elevation in the frame 32.

The array of lamps 48 mounted on the circuit board 46 constitutes a particularly significant feature of the present invention. In one embodiment shown in FIG. 5., the lamps are distributed within a rectangular area A, the sides of which are generally parallel to the respective sides of the rectangular illumination surface 20 on the diffuser 40. The size of the area A does not correspond precisely with the rectangular illumination surface although significant departures of the two areas are not desirable.

Figure 5:
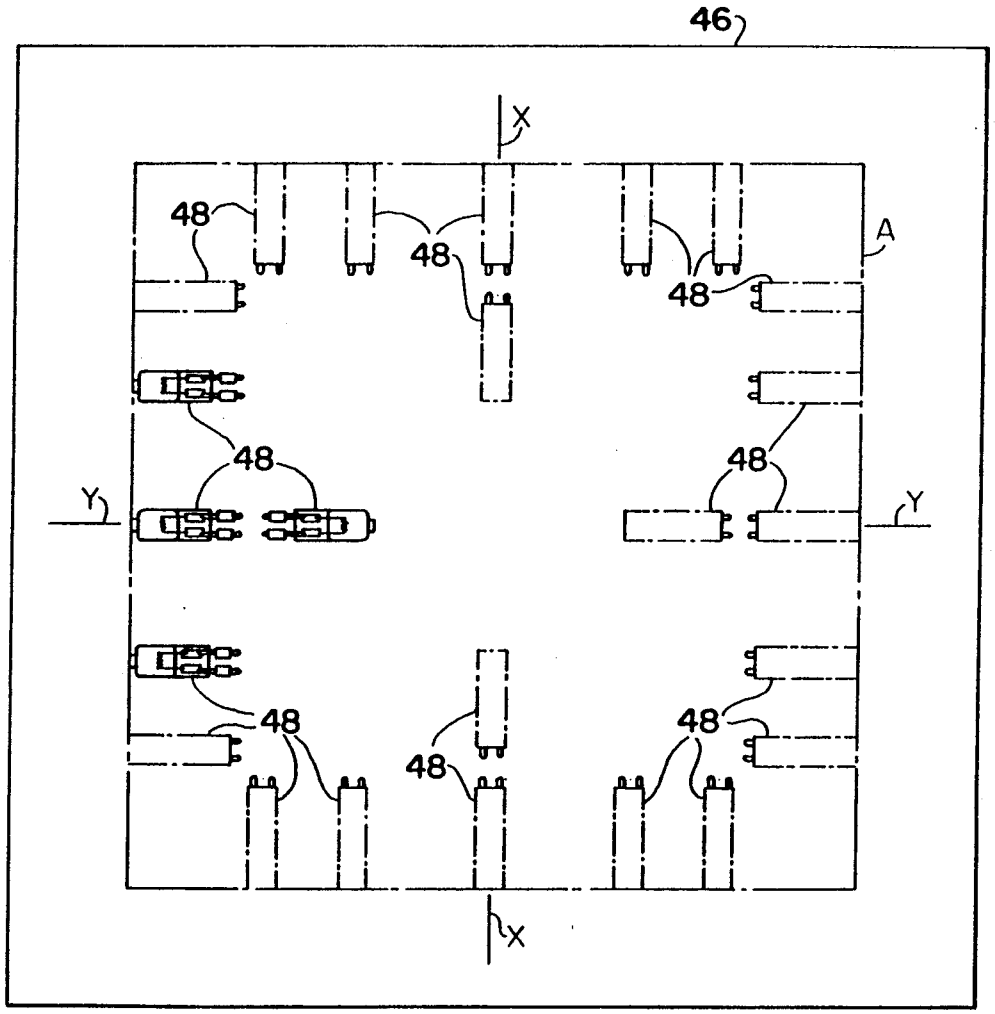
FIG. 5 is a top plan view of the circuit board containing the array of lamps in the light source of FIG. 3.

In the preferred embodiment of the invention, the lamps 48 are quartz halogen lamps having filaments which tend to act as point sources of light. The diffusers assist in distributing the light from these filaments evenly on the illumination surface 20, but the diffusers alone are not capable of providing a uniform distribution or flat field of light at all points on the illumination surface. For this reason, the lamps 48 are specially located within the area A to insure that the brightness or level of illumination across the entire illumination surface is uniform. For example, in one embodiment of the invention with the lamps positioned as illustrated in FIG. 5, a variance as little as 5% was detected across the entire illumination surface by a CCD camera that monitors the illumination at 250,000 independent points on the surface of the diffuser 40. The array of lamps 48 shown in FIG. 5 has been found to be suitable for a 10 inch × 10 inch illumination area defined by the opening 18 for the surface 20, though the surface itself is 13 inches × 13 inches.

The array is characterized by a nonlinear distribution of the lamps in the peripheral region of the rectangular area A. In particular, the lamps are distributed so that the filaments or light emitting elements are more closely positioned to one another or have a high density at the corners of the peripheral region of the rectangular area A. The density gradually decreases and reaches a minimum at the major axes X,Y. The distribution is symmetrical about the major axes, and has proven to be quite effective in generating a flat field of illumination and is believed to approximate a logarithmic distribution in the ideal situation. However, due to the physical constraints of lamp size, positioning and electrical connection, the ideal is not attainable, but results closely approximating the ideal are achievable and have utility as indicated by the 5% variance in illumination or flatness of field mentioned above.

With a large illumination surface 20 additional lamps are needed at regions within the peripheral regions of the area A to achieve flat field illumination. Indeed the embodiment of FIG. 5 illustrates four lamps 48 which are located along the major axes X,Y of the rectangular area A at positions between the peripheral region and the center of the area. The filaments of the four additional lamps are located approximately half way between the edge and the center of the rectangular area. If the area A were oblong rather than square it is contemplated that several interiorially placed lamps as well as additional lamps along the longer sides of the rectangular area will be needed.

Figure 6:
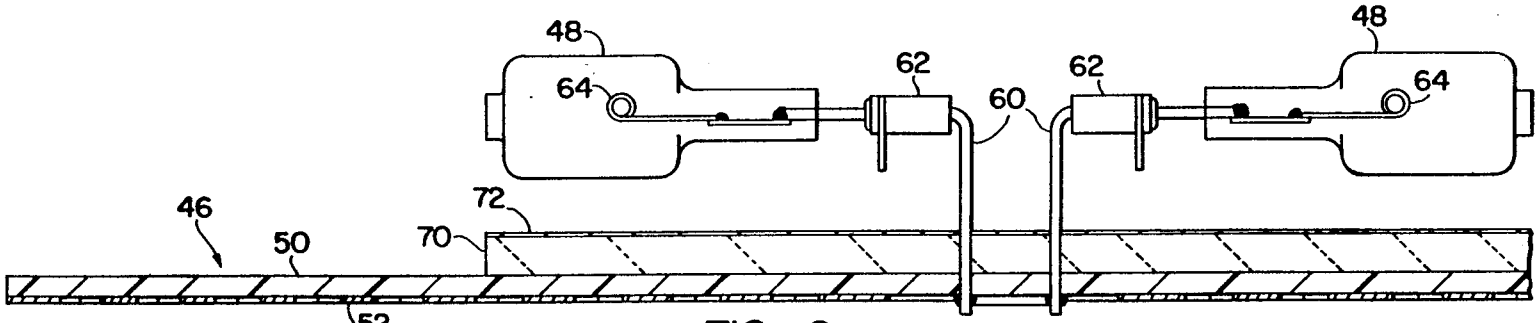
FIG. 6 is fragmentary view showing the circuit board of FIG. 5 in cross section with two of the lamps in the array.
Figure 7:
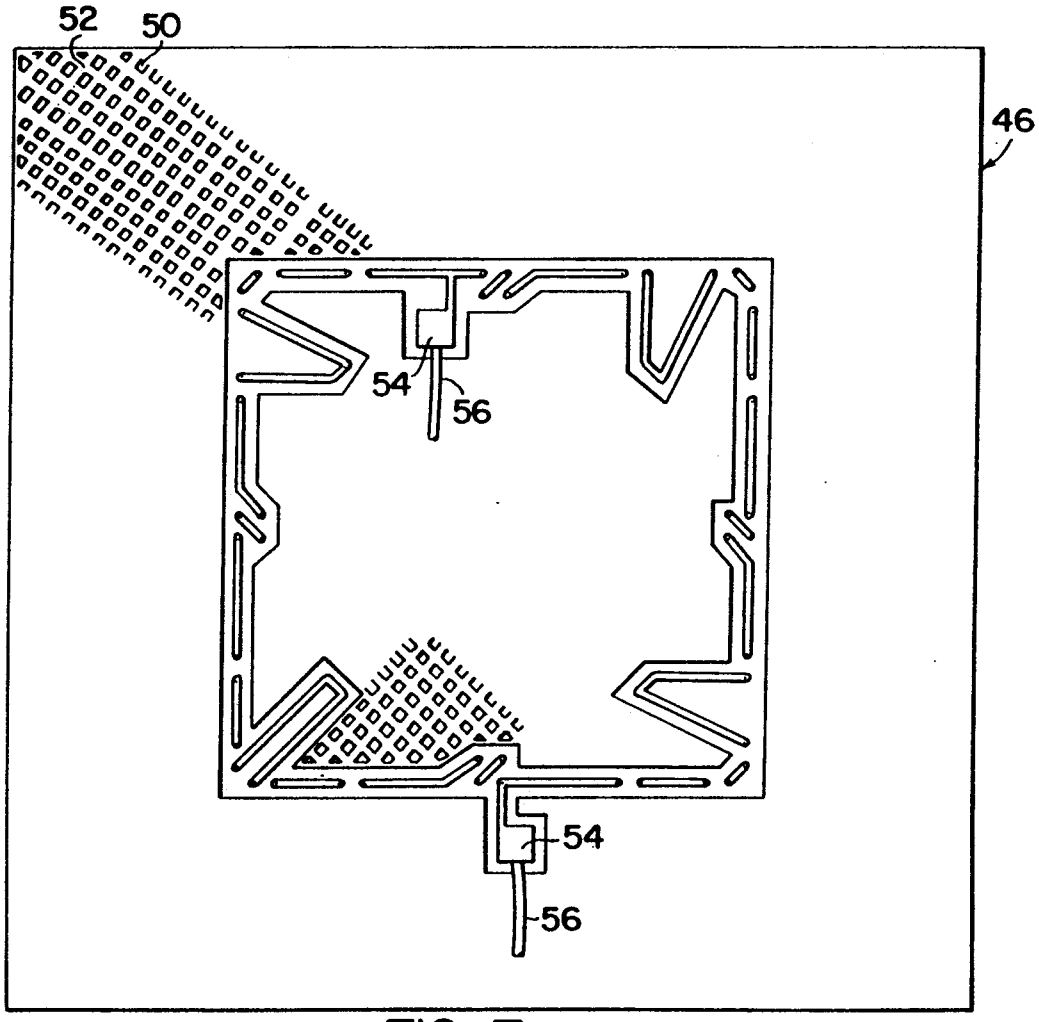
FIG. 7 is a bottom plan view of the circuit board in FIG. 5.

FIG. 6 illustrates in cross section the detailed structure of the circuit board 46 and the mounting of two lamps 48 to the board at one of the major axes X or Y shown in FIG. 5. The circuit board in conventional fashion is composed of a plastic substrate 50 and an electrically conductive cladding 52 defining the circuitry on the bottom side of the board. FIG. 7 is a bottom plan view of the board and illustrates one pattern of the cladding for energizing the lamps 48 in the array illustrated in FIG. 5. It is apparent from the cladding pattern that the lamps on each half of the board are series connected to form essentially two parallel circuits. The series connection of the lamps all located in one section of the array insures that the failure of one of the lamps will result in catastrophic failure of illumination throughout the section. Such a failure can be readily noticed by the operator or may be automatically detected by the camera or by a separate supervisory monitor. The power to the lamps is applied to the electrical circuit through contact pads 54 and leads 56 connected with a DC power supply 58 shown in FIG. 3.

It will be observed that a substantial portion of the cladding 52 covers the lower surface of the circuit board 56 and is not a part of the electrically conductive cladding connected with the lamps. This non-conductive portion of the cladding, which is typically copper, serves as a radiator of heat to dissipate a portion of the large quantity of heat generated by the array of lamps on the opposite side of the circuit board.

As shown in FIG. 6, the lamps 48 are supported from the circuit board 46 on leads 60 passing through holes in the board and soldered to the cladding below. The leads have connectors 62 for each of the lamps 48 and preferably the leads and connectors are gold plated for reliability.

The lamps 48 are disposed in a generally horizontal position and are preferably constructed with a quartz glass envelope and a filament 64. The glass envelope is filled with a halogen gas such as bromine or iodine and when energized the lamp radiates with a color temperature of approximately 3050k.

In one embodiment of the invention the lamp is a 12 volt quartz halogen lamp rated at 50 watts. With 12 such bulbs connected in a series, the DC power supply should be rated at 144 volts. A switching-type power supply manufactured by Unipower Corp. of Pompano Beach, FL, type PH7000F, or by Deltron, Inc. of North Wales, PA, Model V601D04 can be used for this purpose. Both of these supplies produce less than 144 volts but the supplies may be connected in series to reach the required voltage. The supplies are desirable since they have a very low ripple in the DC output. Generally ripple less than 1% is desirable in order to avoid the flicker and other instabilities discussed above.

The upper surface of the circuit board 46 confronting the lamps 48 is covered by an insulation layer 70 of ceramic material to withstand the tremendous heat that is generated by the plurality of lamps 48 in the array. The insulation layer is also coated with a lambertian reflectant 72 to additionally reflect the light and heat upwardly away from the circuit board 46.

The lamps 48 can be shifted slightly due to the flexibility of the leads 60 but once in place the lamps and more particularly the filaments which serve as the light emitting elements should be located equidistant from the diffuser 40 at the illumination surface of the source.

In one embodiment, the entire source for a 10 inch $\times$10 inch illumination area occupies a space of approximate 13 inches$\times$13 inches$\times$5 inches. The source thus represents a far more practical configuration than the integrating spheres of the prior art and yet still provides even illumination with a brightness up to 12000 footlamberts or more than 125,000 lux at the illumination surface. The variation in illumination is as little as 5% and the illumination is balanced at 3200k, the preferred color temperature for most cameras. The color temperature of a halogen lamp is constant throughout 95% of the lamp life, and the source remains relatively cool which protects valuable film, such as aerial reconnaissance photographs which are procured at very high costs. For example, the film temperature is typically below 95° F. after eight hours of continuous operation of the source. With a high intensity source and stable illumination, a complex synchronizing circuitry for scanning the film with the camera is not needed and exposure time is significantly reduced. The source makes possible a number of image enhancement or digital processing functions for generating improved definition, color separations, and numerous other products that would not otherwise be possible with conventional light sources. The source offers flat, direct illumination at the highest possible continuous intensity, the greatest control of spectrum emission at that intensity and stability throughout the life of the lamps.

Figure 8:
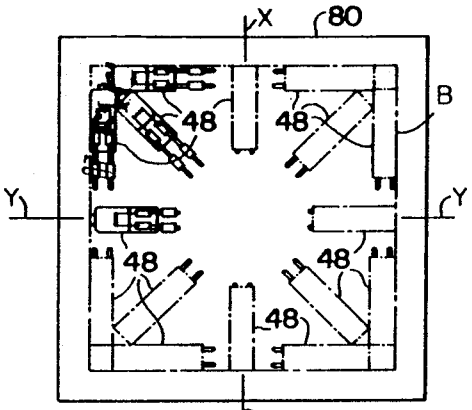
FIG. 8 is a plan view of a circuit board and array of lamps for another embodiment of the invention.

FIG. 8 illustrates in plan view another circuit board 80 with a different array of the lamps 48. The circuit board 80 like the circuit board 46 has a rectangular area B in which the lamps are arrayed, and the lamps are again distributed nonlinearly within the peripheral region of the area. In particular a higher density of lamps is found in the corners of the peripheral regions with a lower density of lamps at the major axes X,Y. The positioning of the lamps in the corners at 45° to one another helps to increase the density of the light emitting elements of the lamps in the corners of the rectangular area B and this positioning may also be utilized in larger sources such as that shown in FIG. 5.

The array of lamps 48 illustrated on the circuit board 80 of FIG. 8 also produces a high intensity, flat field illumination at the illumination surface of the source, but the array of lamps shown in FIG. 8 is more appropriate for a smaller rectangular illumination surface such as a 5 inch×5 inch surface.

Accordingly, while the present invention has been described in several preferred embodiments, it should be understood that numerous modifications and substitutions can be had without departing from the spirit of the invention. Obviously the number of lamps that are employed in a given source will increase with the area to be illuminated if the same general intensity is desired. In each instance, at least some of the lamps are disposed in a nonlinear array with a higher concentration or density of lamps in the corners of a rectangular area. Quartz halogen lamps are preferred because they provide a color temperature closely approximating the preferred temperature for most cameras and they maintain a fairly stable color temperature and high intensity throughout their lifetime. The particular supporting structure for the lamps and reflectant may be varied from that which is shown in the drawings. The number of diffusers and the utilization of the heat shield may be varied as desired. Accordingly the present invention has been described in several preferred embodiments by way of illustration rather than limitation.

I claim:

1. A high intensity planar light source comprising:

a frame defining a rectangular illumination surface on which films and other objects to be illuminated are positioned for viewing when illuminated by the source;

an array of lamps, each having a light emitting element, all disposed within a rectangular area having major axes extending parallel to the sides of the rectangular area and located midway between the corners of the rectangular area and generally equidistant from the rectangular illumination surface defined by the frame, the sides of the rectangular area being generally parallel to the respective sides of the rectangular illumination surface, at least some of the lamps being arranged with the light emitting elements distributed along a peripheral region of the rectangular area with a higher density of elements near the corners of the rectangular area than at the major axes of the area.

2. A high intensity light source as defined in claim 1 wherein:

the lamps arranged with light emitting elements along the peripheral region have the elements arranged with a gradually decreasing density from the corners to the major axes of the area.

3. A high intensity light source as defined in claim 2 wherein:

three lamps are clustered at approximately 45° in each corner of the rectangular area.

4. A high intensity light source as defined in claim 1 wherein:

a single lamp is placed in each peripheral region at the major axes of the rectangular area and the remaining lamps are symmetrically disposed with respect to the major axes.

5. A high intensity light source as defined in claim 1 wherein:

additional lamps are located along the major axes of the rectangular area at positions between the peripheral region and the center of the rectangular area.

6. A high intensity light source as defined in claim 1 further including reflective means disposed adjacent the array of lamps for reflecting light from the lamps toward the rectangular illumination surface.

7. A high intensity light source as defined in claim 1 further including a circuit board supported on the frame and on which the array of lamps is mounted, the board having electrical circuitry connected with the lamps for energizing the lamps.

8. A high intensity light source as defined in claim 7 wherein:

an insulation layer of a ceramic material is spread on the side of the circuit board facing the array of lamps and a reflective coating overlies the insulation layer.

9. A high intensity light source as defined in claim 7 wherein:

the electrical circuitry on the circuit board interconnects in series one group of the lamps located in one section of the array whereby a failure of one of the lamps in the series is signaled by loss of illumination throughout the section of the array.

10. A high intensity light source as defined in claim 1 further including a DC power supply connected to the lamps for energizing the lamps with DC current.

11. A high intensity light source as defined in claim 1 wherein the lamps are halogen lamps.

12. A high intensity light source as defined in claim 1 wherein:

the illumination surface is the surface of a plate-like diffuser; a transparent heat absorbing glass plate is interposed between the plate-like diffuser and the array of lamps, and a further plate-like diffuser is interposed between the heat absorbing glass and the array of lamps, the plate-like diffuser, the heat absorbing glass plate, the further plate-like diffuser and the array of lamps all being supported in relationship to one another by the frame.

13. Apparatus for illuminating film, transparencies and like objects comprising:

a ventilated frame;

a high intensity light source mounted within the frame and having an illuminated surface exposed at one side of the frame for illuminating film, transparencies and like objects, the light source including: a diffuser defining the illuminated surface exposed at one side of the frame, and an array of lamps arranged within a rectangular area having major axes extending parallel to the sides of the rectangular area and located midway between the corners of the rectangular area and with light emitting portions of the lamps equally spaced from the diffuser, the distribution of the light emitting portions of the lamps being nonlinear along peripheral regions of the rectangular area with a higher density at the corners of the area than at the major axes of the area.

14. Apparatus for illuminating as defined in claim 13 wherein:

some of the lamps in the array are located closer to the center of the rectangular area than the lamps distributed in the peripheral regions.

15. Apparatus for illuminating as defined in claim 13 wherein a transparent heat shield is mounted in the ventilated frame between the array of lamps and the diffuser.

16. Apparatus for illuminating as defined in claim 13 wherein the lamps in the array are halogen lamps.

17. Apparatus for illuminating as defined in claim 13 wherein the lamps in the corners of the rectangular area are arranged at 45° to one another.

18. Apparatus for illuminating as defined in claim 13 wherein the lamps in one portion of the array are series connected for failure detection.

19. Apparatus for illuminating as defined in claim 13 further including a low ripple, DC power supply connected with the array of lamps for energization.

20. Apparatus for illuminating as defined in claim 13 wherein the lamps in the array are symmetrically disposed about the major axes of the rectangular area.

* * * * *